US008397824B2

(12) United States Patent
Wright et al.

(10) Patent No.: US 8,397,824 B2
(45) Date of Patent: Mar. 19, 2013

(54) HYDRAULIC CONTROL SYSTEM FOR ACTUATING DOWNHOLE TOOLS

(75) Inventors: Adam Davis Wright, McKinney, TX (US); Vincent Paul Zeller, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 12/960,895

(22) Filed: Dec. 6, 2010

(65) Prior Publication Data

US 2012/0138305 A1 Jun. 7, 2012

(51) Int. Cl.
*E21B 34/06* (2006.01)

(52) U.S. Cl. ..... 166/373; 166/264

(58) Field of Classification Search ..... 166/264, 166/373–375, 319–321, 386
See application file for complete search history.

(56) References Cited

U.S. PATENT DOCUMENTS

| | | | | |
|---|---|---|---|---|
| 2,307,171 | A * | 1/1943 | Tutton | 417/111 |
| 5,050,675 | A * | 9/1991 | Upchurch | 166/373 |
| 5,050,681 | A | 9/1991 | Skinner | |
| 5,101,907 | A * | 4/1992 | Schultz et al. | 166/386 |
| 5,127,477 | A | 7/1992 | Schultz | |
| 5,273,112 | A | 12/1993 | Schultz | |
| 5,273,113 | A | 12/1993 | Schultz | |
| 5,355,960 | A | 10/1994 | Schultz et al. | |
| 5,412,568 | A | 5/1995 | Schultz | |
| 5,490,564 | A | 2/1996 | Schultz et al. | |
| 6,484,800 | B2 * | 11/2002 | Carmody et al. | 166/53 |
| 6,668,936 | B2 | 12/2003 | Williamson, Jr. et al. | |
| 7,614,454 | B2 * | 11/2009 | Buyers et al. | 166/386 |
| 7,921,876 | B2 * | 4/2011 | Wright et al. | 137/625.21 |
| 2002/0014338 | A1 * | 2/2002 | Purkis et al. | 166/375 |
| 2004/0069491 | A1 * | 4/2004 | Garay et al. | 166/320 |
| 2010/0264346 | A1 * | 10/2010 | Bussear | 251/250.5 |
| 2011/0100641 | A1 * | 5/2011 | Briquet et al. | 166/373 |
| 2011/0155393 | A1 * | 6/2011 | Loretz et al. | 166/374 |

* cited by examiner

*Primary Examiner* — David Bagnell
*Assistant Examiner* — Kipp Wallace
(74) *Attorney, Agent, or Firm* — Lawrence R. Youst

(57) ABSTRACT

A hydraulic control system (100) for actuating a downhole tool. The hydraulic control system (100) includes a plurality of valve members (124) operable to selectively allow and prevent fluid communication between high and low pressure sources (54, 56) and first and second sides (58, 60) of an actuator (64) operably associated with the downhole tool. In the hydraulic control system (100), a first valve member (124) is ported between the high pressure source (54) and the first side (58) of the actuator (64), a second valve member (124) is ported between the low pressure source (56) and the first side (58) of the actuator (64), a third valve member (124) is ported between the high pressure source (54) and the second side (60) of the actuator (64) and a fourth valve member (124) is ported between the low pressure source (56) and the second side of the actuator (60).

14 Claims, 4 Drawing Sheets

HYDRAULIC CONTROL SYSTEM FOR ACTUATING DOWNHOLE TOOLS

TECHNICAL FIELD OF THE INVENTION

This invention relates, in general, to equipment utilized in conjunction with operations performed in subterranean wells and, in particular, to a hydraulic control system for actuating downhole tools.

BACKGROUND OF THE INVENTION

Without limiting the scope of the present invention, its background will be described in relation to actuating hydraulically operated well testing tools, as an example.

In oil and gas wells, it is common to conduct well testing and stimulation operations to determine production potential and enhance that potential. For example, hydraulically operated downhole tools have been developed which operate responsive to pressure differentials in the wellbore that can sample formation fluids for testing or circulate fluids therethrough. These tools typically incorporate both a ball valve and lateral circulation ports. Both the ball valve and circulation ports are operable between open and closed positions. Commonly, these tools are capable of operating in different modes such as a drill pipe tester valve, a circulation valve and a formation tester valve, as well as providing its operator with the ability to displace fluids in the pipe string above the tool with nitrogen or another gas prior to testing or retesting. A popular method of employing the circulating valve is to dispose it within a wellbore and maintain it in a well test position during flow periods with the ball valve open and the circulation ports closed. At the conclusion of the flow periods, the tool is moved to a circulating position with the ports open and the ball valve closed.

To actuate such hydraulically actuated well tools, a hydraulic control system is typically use. In certain installations, the hydraulic control system has been positioned at the surface. It has been found, however, that it is uneconomical to run the required hydraulic control lines from the surface to the hydraulically actuated well tools for well testing. Accordingly, attempts have been made to position the hydraulic control system downhole. These downhole hydraulic control systems have typically used control valves having sliding sleeves, poppets and the like that include o-rings or other elastomeric seals to selectively control fluid communication. It has been found, however, that due to large pressure differentials, limitations on size, temperature extremes and near zero leak rate tolerance, conventional hydraulic control valves that utilize elastomeric seals are not suitable.

Therefore, a need has arisen for an improved hydraulic control system for actuating downhole tools. In addition, a need has arisen for such an improved hydraulic control system that does not require hydraulic control lines running from the surface to the hydraulically actuated well tools. Further, a need has arisen for such an improved hydraulic control system that does not utilize control valves having elastomeric seals to selectively control fluid communication.

SUMMARY OF THE INVENTION

The present invention disclosed herein is directed to an improved hydraulic control system for actuating downhole tools that utilizes a plurality of valve members that provide reliable, repeatable sealing. In addition, the improved hydraulic control system of the present invention does not require hydraulic control lines running from the surface to the hydraulically actuated well tools. Further, the improved hydraulic control system of the present invention does not utilize control valves having elastomeric seals to selectively control fluid communication.

In one aspect, the present invention is directed to a hydraulic control system for actuating a downhole tool. The hydraulic control system includes a plurality of valve members operable to selectively allow and prevent fluid communication between high and low pressure sources and first and second sides of an actuator operably associated with the downhole tool. In the hydraulic control system, a first pair of valve members is ported to the high pressure source, a second pair of valve members is ported to the low pressure source, a third pair of valve members is ported to the first side of the actuator and a fourth pair of valve members is ported to the second side of the actuator, thereby enabling reliable and repeatable operation of the hydraulic control system.

In one embodiment, each of the valve members is a 2-way valve. In another embodiment, each of the valve members is a 2-position valve. In a further embodiment, each of the valve members is a needle valve. In yet another embodiment, each of the valve members has a stem that is operable to form a metal-to-metal seal with a valve seat.

In one embodiment, the hydraulic control system includes a plurality of motors, one associated with each valve member, such that each motor operates one of the valve members between open and closed positions. In another embodiment, the hydraulic control system includes a drive assembly operably associated with the valve members to operate the valve members between open and closed positions. In this embodiment, the drive assembly may be operable to sequentially operate the valve members one at a time. Also in this embodiment, the drive assembly may include a ring gear and at least one motor. In a further embodiment, the hydraulic control system includes at least one power and control assembly.

In another aspect, the present invention is directed to a hydraulic control system for actuating a downhole tool. The hydraulic control system includes a plurality of valve members operable to selectively allow and prevent fluid communication between high and low pressure sources and first and second sides of an actuator operably associated with the downhole tool. In the hydraulic control system, a first valve member is ported between the high pressure source and the first side of the actuator, a second valve member is ported between the low pressure source and the first side of the actuator, a third valve member is ported between the high pressure source and the second side of the actuator and a fourth valve member is ported between the low pressure source and the second side of the actuator, thereby enabling reliable and repeatable operation of the hydraulic control system

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
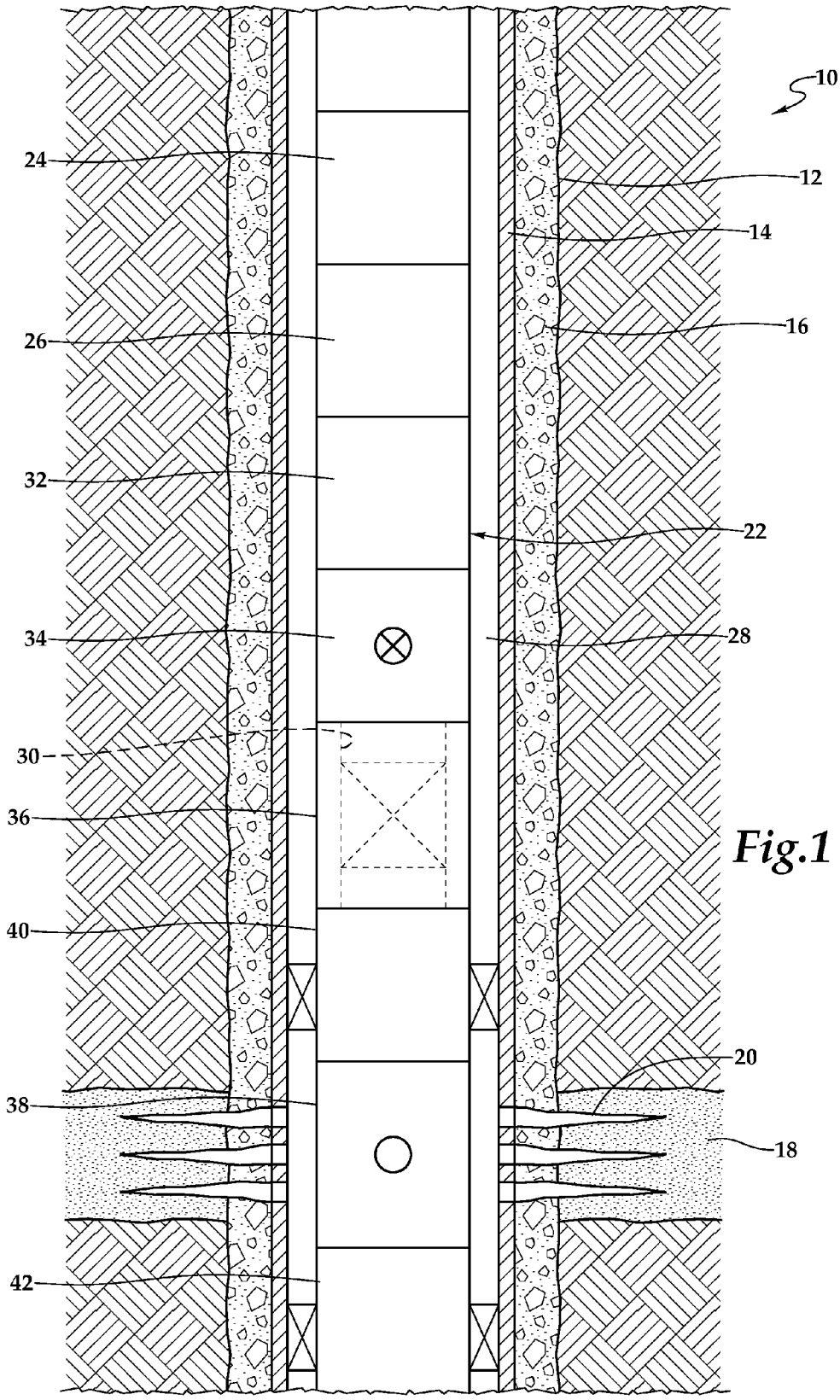
FIG. 1 is a schematic illustration, partially in cross sectional, of a well system including a hydraulic control system for actuating downhole tools according to an embodiment of the present invention.

Referring initially to FIG. 1, therein is depicted a well system embodying principles of the present invention that is schematically illustrated and generally designated 10. Well system 10 includes a wellbore 12 having a casing string 14 secured therein by cement 16. Wellbore 12 extends through the various earth strata including formation 18. Communication has been established between the interior of casing string 14 and formation 18 via perforations 20. Disposed within casing string 14 is a tool string 22 operable to perform a drill stem test.

In the illustrated embodiment, tool string 22 includes a low pressure source 24 such as an atmospheric chamber or a low pressure side of a pump. Tool string 22 also includes a high pressure source 26 such as a pressurized gas chamber, hydrostatic pressure in the well, or a high pressure side of a pump. It should be understood by those skilled in the art that any type of pressure source could be used, and it is not necessary for any of the pressure sources to be interconnected in tool string 22, in keeping with the principles of the invention. For example, if hydrostatic pressure is used as a pressure source, the annulus 28 or central passageway 30 could serve as a pressure source.

In the illustrated embodiment, tool string 22 also includes a hydraulic control system 32 that is used to control the operation of actuators within well tools 34, 36 that are interconnected within tool string 22 and are depicted as a circulating valve and a tester valve for a drill stem test. For example, hydraulic control system 32 controls operation of the actuators by selectively applying pressure to pistons of the actuators of well tools 34, 36, thereby controlling fluid flow between central passageway 30, annulus 28 and formation 18. The actuators of the well tools 34, 36 are of conventional design and so are not described further herein. Tool string 22 further includes a ported sub 38 positioned between two seal assemblies 40, 42 that provides a passageway and isolation for formation fluids to enter tool string 22.

Even though FIG. 1 depicts a vertical section of a wellbore, it should be understood by those skilled in the art that the present invention is equally well suited for use in wellbores having other directional configurations including horizontal wellbores, deviated wellbores, slanted wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. In addition, even though FIG. 1 depicts a circulating valve and a tester valve for a drill stem test, it should be understood by those skilled in the art that the present invention is equally well suited for actuation of any other type or combination of well tools or other tools outside of a well environment.

Figure 2:
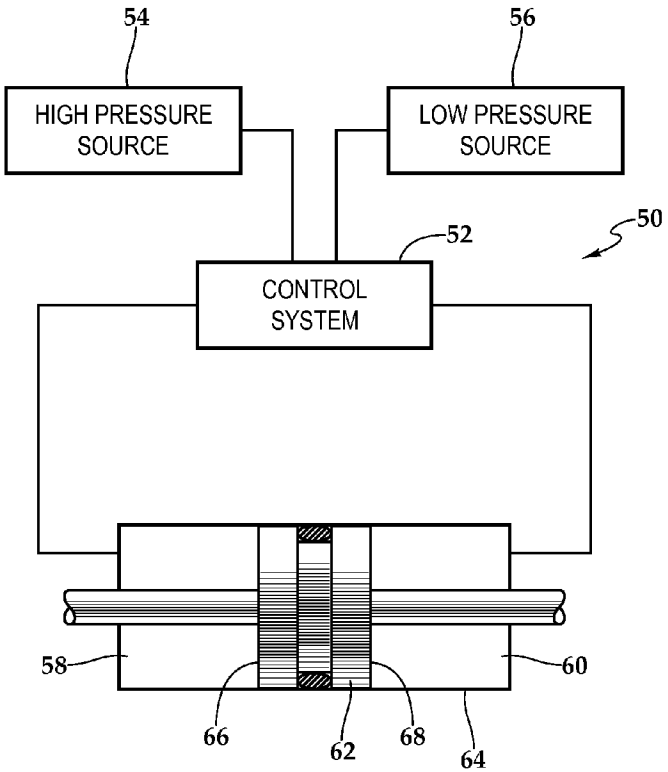
FIG. 2 is a schematic hydraulic circuit diagram of a hydraulic control system for actuating downhole tools according to an embodiment of the present invention.

Referring additionally now to FIG. 2, a schematic hydraulic circuit diagram of a hydraulic control system is representatively illustrated and generally designated 50. As illustrated, a control system 52 is interconnected between pressure sources 54, 56 and chambers 58, 60 on opposite sides of a piston 62 in an actuator 64. Chambers 58, 60 are in fluid communication with respective opposing surface areas 66, 68 on piston 62. In other embodiments, however, it would not be necessary for chambers 58, 60 and surface areas 66, 68 to be on opposite sides of piston 62. In addition, it is also not necessary for piston 62 to have a cylindrical shape as depicted in FIG. 2, for example, the piston could alternatively have an annular shape or any other shape.

In the illustrated embodiment, pressure source 54 will be described as a high pressure source and pressure source 56 will be described as a low pressure source. In other words, pressure source 54 supplies an increased pressure relative to the pressure supplied by pressure source 56. For example, pressure source 54 could supply hydrostatic pressure and pressure source 56 could supply substantially atmospheric pressure. The preferable feature is that a pressure differential between pressure sources 54, 56 is maintained for operation of actuator 64. For example, when it is desired to displace piston 62 to the right, control system 52 is operated to permit fluid communication between pressure source 54 and chamber 58, and to permit fluid communication between pressure source 56 and chamber 60. When it is desired to displace piston 62 to the left, control system 52 is operated to permit fluid communication between pressure source 54 and chamber 60, and to permit fluid communication between pressure source 56 and chamber 58. In certain embodiments, control system 52 may be operated to prevent fluid communication between each of the chambers 58, 60 and either of the pressure sources 54, 56. In this configuration, piston 62 can be secured in a certain position by preventing fluid communication with each of the chambers 58, 60.

Even though FIG. 2 depicts only one actuator 64, one piston 62 and two pressure sources 54, 56, it should be understood by those skilled in the art that the hydraulic control system of present invention may be operated with any number or combination of these elements without departing from the principles of the invention.

Figure 3:
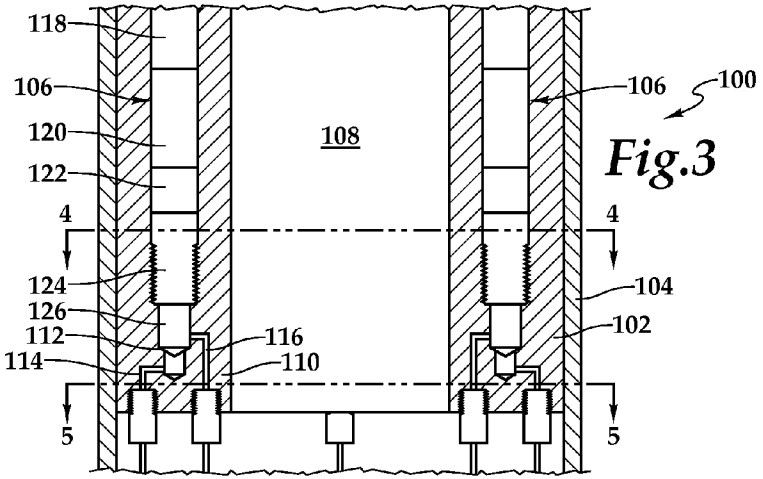
FIG. 3 is cross sectional view of a hydraulic control system for actuating downhole tools according to an embodiment of the present invention.
Figure 4:
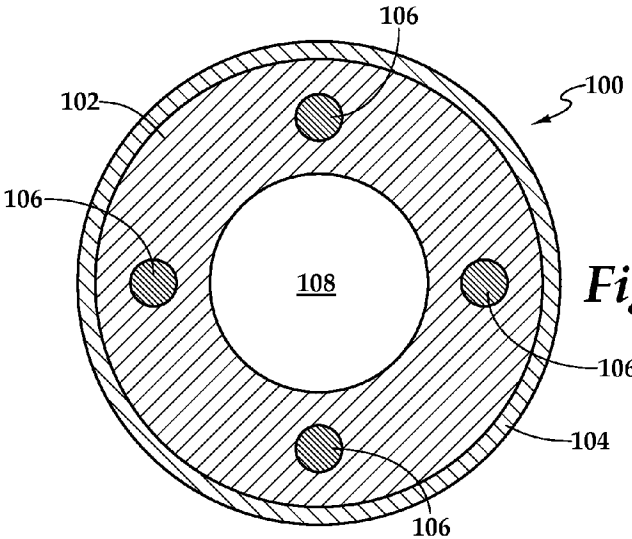
FIG. 4 cross sectional view of a hydraulic control system for actuating downhole tools taken along line 4-4 of FIG. 3.

Referring next to FIG. 3, a hydraulic control system for actuating downhole tools is representatively illustrated and generally designated 100. Control system 100 includes a control system housing 102 securably positioned within a tubular member 104. Control system housing 102 is designed to securably receive four control assemblies 106 therein, as best seen in FIG. 4, and has a central passageway 108 extending axially therethrough. Control system housing 102 includes a manifold section 110 that has the desired porting and connections to enable and disable fluid communication therethrough. Manifold section 110 includes a valve seat 112 associated with each control assembly 106. In addition, manifold section 110 includes porting 114 that is in fluid communication with one of the pressure sources 54, 56 and porting 116 that is in fluid communication with one of the chambers 58, 60, thereby selectively enabling the application of pressure between pressure sources 54, 56 and actuator 64.

Each of the control assemblies 106 is substantially identical and includes a power and control section 118 such as a battery and circuitry required to operate the associated control assembly 106 including the ability to send and received command, control and status signals to and from other downhole or surface components (not pictured). Control assemblies 106 also each include a motor 120 that is preferably an electric motor, but could alternatively be a mechanically driven or hydraulically driven motor, that generates the desired rotation of a shaft. Each control assembly 106 may optionally include a torque limiter 122 that is operably engaged with the shaft of motor 102. Each control assembly 106 also includes a valve member depicted as a 2-way (two ports), 2-position (on and off) needle valve 124 having a stem 126. Stem 126 is axially moveable relative manifold section 110 and is operable to form a metal-to-metal seal against valve seat 112. Torque limiters 122 are designed to assure the proper sealing force between stems 126 and valve seats 112.

In operation when it is desired to change the fluid communication path through control system 100, the control assemblies 106 are preferably sequentially operated to retract or extend a stem 126 of a needle valve 124 to enable or disable fluid communication between a port 114 and a port 116 by energizing a motor 106 in the desired direction via a power and control section 118. This operation will achieve reliable shifting of piston 62 in the desired direction within actuator 64 as explained in greater detail below.

Even though each of the four control assemblies 106 has been described in FIG. 2 as having a power and control section 118, those skilled in the art will recognized that a one-to-one relationship between motors 120 and power and control sections 118 is not required and that any number of power and control sections 118 both less than or greater than four, including a single power and control section, is possible and considered within the scope of the present invention. Also, it should be understood by those skilled in the art that even though the power and control sections have been described as being located within control system 100, the power and control for control system 100 could alternatively be provided from another downhole tool or location, via a surface system or via a distributed system wherein certain components are positioned downhole and certain components are positioned on the surface with communication enabled therebetween through wired or wireless communications.

Figure 5A:
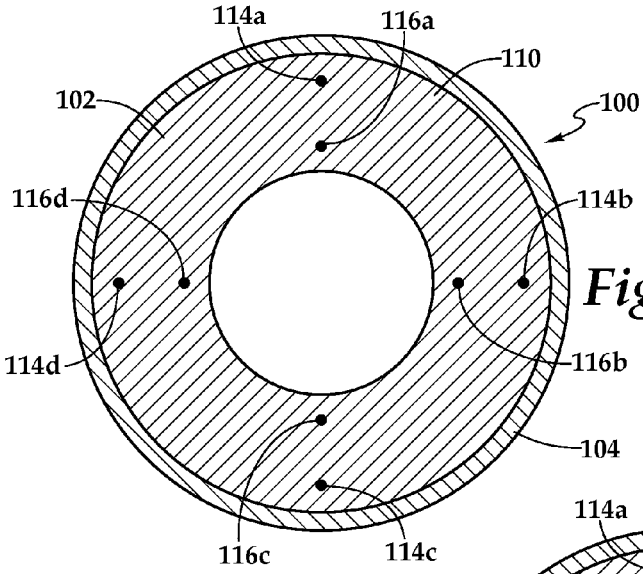
FIGS. 5A-5C are cross sectional views of a hydraulic control system for actuating downhole tools taken along line 5-5 of FIG. 3 in various operating configurations according to an embodiment of the present invention.
Figure 5B:
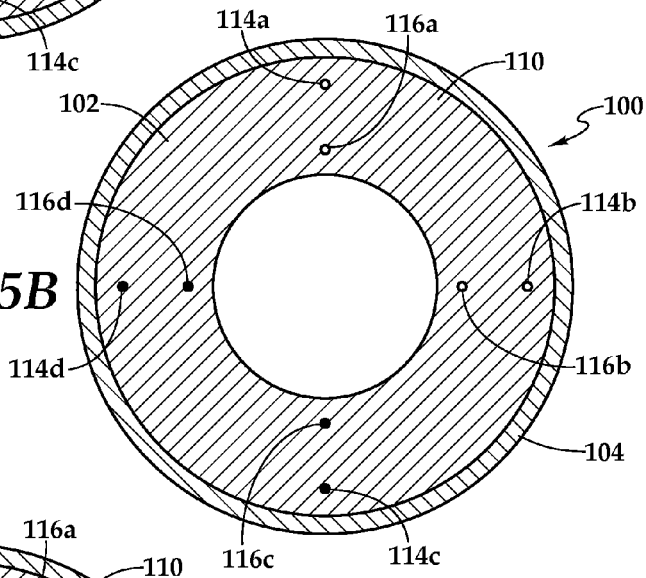
Figure 5C:
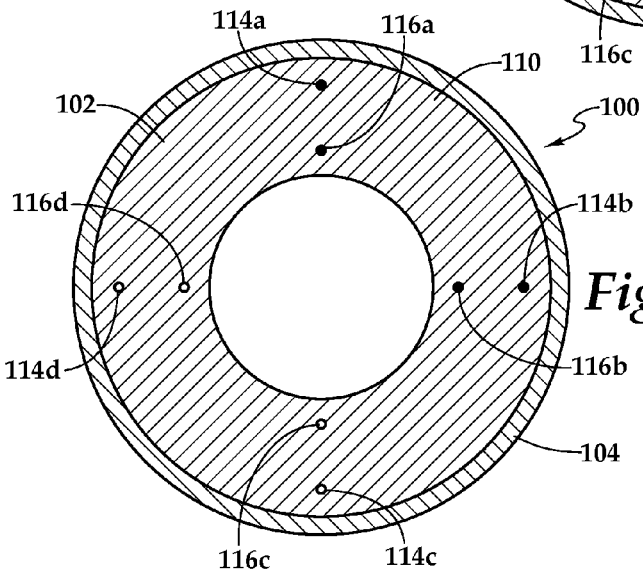

Referring next to FIGS. 5A-5C, the various porting sequences of control system 100 will be described. In the illustrated embodiment, manifold section 110 includes eight ports 114*a-d* and 116*a-d*. As stated above, each of ports 114*a-d* is selectively in fluid communication with a respective one of ports 116*a-d* depending upon the position of the associated stem 126. In addition, the ports 114*a-d* and 116*a-d* in this example are connected as follows: ports 114*a*&*d* are connected to low pressure source 56, ports 114*b*&*c* are connected to high pressure source 54, ports 116*a*&*c* are connected to actuator chamber 60 and ports 116*b*&*d* are connected to actuator chamber 58. In FIG. 5A, each of ports 114*a-d* and 116*a-d* are depicted as solid circles indicating the associated stem 126 is in metal-to-metal sealing engagement with the associated valve seat 112. In this configuration, piston 62 can be secured in a certain position by preventing fluid communication with each of the chambers 58, 60.

In FIG. 5B, two of the control assemblies 106 have been operated to open certain fluid communication pathways. Specifically, fluid communication between ports 114*a* and 116*a* is allowed and fluid communication between ports 114*b* and 116*b* is allowed as indicated by the open circles of FIG. 5B. In this configuration, high pressure source 54 is in fluid communication with chamber 58 and low pressure source 56 is in fluid communication with chamber 60, thereby biasing piston 62 of actuator 64 to the right as viewed in FIG. 2. Operation of the needle valves 124 from the configuration depicted in FIG. 5A to the configuration depicted in 5B may occur simultaneously or sequentially.

In FIG. 5C, the control assemblies 106 have been operated to close certain fluid communication pathways and open other fluid communication pathways. Specifically, fluid communication between ports 114*a* and 116*a* is disallowed and fluid communication between ports 114*b* and 116*b* is disallowed as indicated by the solid circles. In addition, fluid communication between ports 114*c* and 116*c* is allowed and fluid communication between ports 114*d* and 116*d* is allowed as indicated by the open circles. In this configuration, high pressure source 54 is in fluid communication with chamber 60 and low pressure source 56 is in fluid communication with chamber 58, thereby biasing piston 62 of actuator 64 to the left as viewed in FIG. 2. Operation of the needle valves 124 from the configuration depicted in FIG. 5B to the configuration depicted in 5C may occur simultaneously or preferably sequentially by first closing the needle valves 124 associated with ports 114*a*&116*a* and ports 114*b*&116*b* and then opening the needle valves 124 associated with ports 114*c*&116*c* and ports 114*d*&116*d*. The process of opening and close needle valves 124 to operate piston 62 of actuator 64 from left to right and right to left may occur as many times as required according to the well testing protocol.

Figure 6:
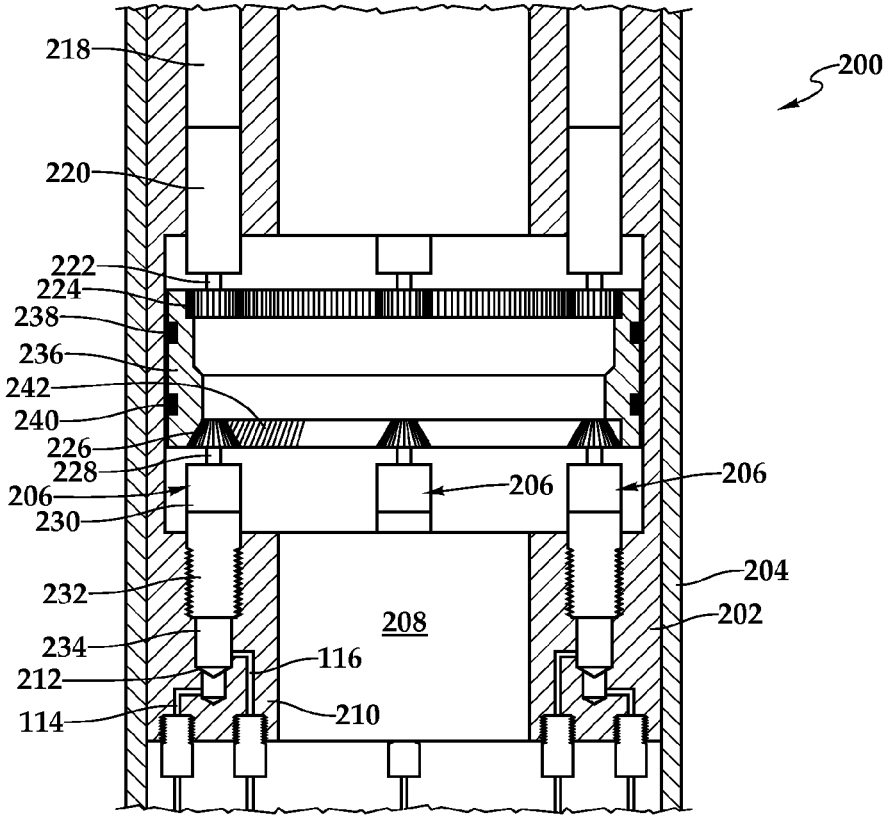
FIG. 6 is cross sectional view of a hydraulic control system for actuating downhole tools according to an embodiment of the present invention.

Referring next to FIG. 6, a hydraulic control system for actuating downhole tools is representatively illustrated and generally designated 200. Control system 200 includes a control system housing 202 securably positioned within a tubular member 204. Control system housing 202 is designed to securably receive four control assemblies 206 therein at 90 degree intervals from one another and has a central passageway 208 extending axially therethrough. Control system housing 202 includes a manifold section 210 that has the desired porting and connections to enable and disable fluid communication therethrough. Manifold section 210 includes a valve seat 212 associated with each control assembly 206. In addition, manifold section 210 includes porting 114 that is in fluid communication with one of the pressure sources 54, 56 and porting 116 that is in fluid communication with one of the chambers 58, 60, thereby selectively enabling the application of pressure between pressure sources 54, 56 and actuator 64.

Each of the control assemblies 206 is substantially identical and includes a power and control section 218 such as a battery and circuitry required to operate the associated control assembly 206 including the ability to send and received command, control and status signals to and from other downhole or surface components (not pictured). Control assemblies 206 also each include a motor 220 that is preferably an electric motor that generates the desired rotation of a shaft 222 that turns a gear 224. Each control assembly 206 includes a gear 226 that turns a shaft 228 connected to an optional torque limiter 230. Each control assembly 206 also includes a valve member depicted as a 2-way, 2-position needle valve 232 having a stem 234. Stem 234 is axially moveable relative manifold section 210 and is operable to form a metal-to-metal seal against valve seat 212. Torque limiters 230 are designed to assure the proper sealing force between stems 234 and valve seats 212.

Figure 7:
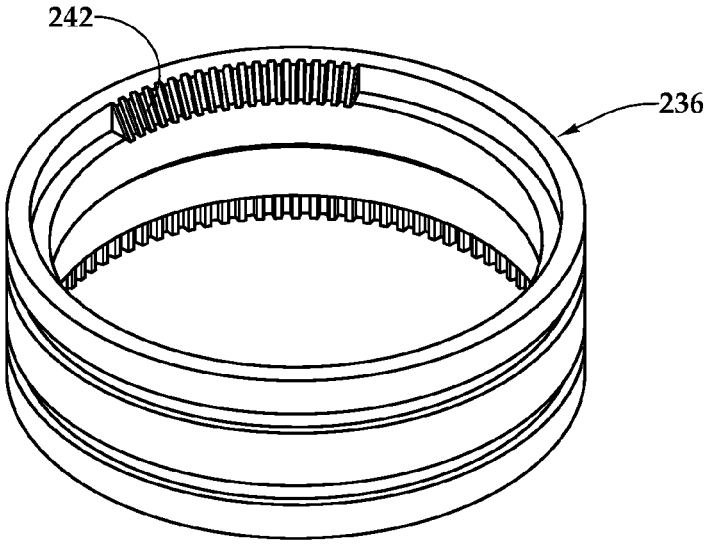
FIG. 7 is perspective view of a ring gear for use in a hydraulic control system for actuating downhole tools according to an embodiment of the present invention.

Operably positioned between gears 224 and gears 226 is a ring gear 236 that transfers rotary motion of gears 224 to gears 226. Ring gear 236 is rotatable within control system housing 202 and preferably includes one or more bearing 238, 240. Together, ring gear 236 and motors 220 may be considered to be a drive assembly. As best seen in FIG. 7, ring gear 236 has gear teeth 242 that extend only partially circumferentially about the inner lower surface of ring gear 236 (as seen from the view in FIG. 6). This configuration allows for operation of a single control assembly 206 at a time as ring gear 236 is rotated by motors 220, as explained in greater detail below. In the illustrated embodiment, gear teeth 242 extend approximately 60 degrees about the circumference of ring gear 242, however, those skilled in the art will recognize that gear teeth 242 could extend other circumferential distances around ring gear 242 both less than or greater than 60 degrees including, but not limited to, between about 30 degrees and about 90 degrees depending upon the required rotation to open and close needle valves 232 including suitable over rotation of, for example, ten percent, which engages torque limiters 130 to assure full valve closure and the proper sealing force between stems 234 and valve seats 212.

Even though each of the four control assemblies 206 has been described in FIG. 6 as having a power and control section 218 and a motor 220, those skilled in the art will recognized that the mechanical linkage provided by ring gear 242 eliminates the need to have a one-to-one relationship between motors 220 and valves 232. Accordingly, control system 200 could have any number of motors 220 that impart rotary motion to ring gear 242 both less than or greater than four motors including a single motor. Likewise, regardless of the number of motors 220, control system 200 could have a different number of power and control sections 218 both less than or greater than four including a single power and control section.

In operation when it is desired to change the fluid communication path through control system 200, the control assemblies 206 are sequentially operated to retract or extend a stem 234 of a needle valve 232 to enable or disable fluid communication between a port 114 and a port 116 by energizing motors 206 in the desired direction via power and control sections 218. This operation will achieve reliable shifting of piston 62 in the desired direction within actuator 64.

Referring collectively to FIGS. 2, 5A-5C and 6, a more specific operation of control system 200 is described. Initially, gear teeth 242 are preferably located circumferentially between the control assemblies 206 that operate ports 114*a*&116*a* and ports 114*b*&116*b* such that all needle valves 232 are in the closed position, as best seen in FIG. 5A. In this manner, when it is desired to bias piston 62 of actuator 64 to the right, as seen in FIG. 2, rotation of ring gear 242 in a clockwise direction, would open fluid communication between ports 114*a* and 116*a* then open fluid communication between ports 114*b* and 116*b*, as best seen in FIG. 5B. In this configuration, high pressure source 54 is in fluid communication with chamber 58 and low pressure source 56 is in fluid communication with chamber 60. When it is desired to bias piston 62 of actuator 64 to the left, as seen in FIG. 2, rotation of ring gear 242 in a counterclockwise direction, would close fluid communication between ports 114*b* and 116*b* then close fluid communication between ports 114*a* and 116*a*, as best seen in FIG. 5A. Further rotation of ring gear 242 in a counterclockwise direction, would open fluid communication between ports 114*d* and 116*d* then open fluid communication between ports 114*c* and 116*c*, as best seen in FIG. 5C. In this configuration, high pressure source 54 is in fluid communication with chamber and low pressure source 56 is in fluid communication with chamber 58. When it is desired close all needle valves 232, rotation of ring gear 242 in a clockwise direction, would close fluid communication between ports 114*c* and 116*c* then close fluid communication between ports 114*d* and 116*d*, as best seen in FIG. 5A. The process of opening and close needle valves 232 to operate piston 62 of actuator 64 from left to right and right to left may occur as many times as required according to the well testing protocol.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A hydraulic control system for actuating a downhole tool, the hydraulic control system comprising:

a plurality of valve members operable to selectively allow and prevent fluid communication between high and low pressure sources and first and second sides of a piston disposed in an actuator operably associated with the downhole tool; and a drive assembly including a ring gear and at least one motor operably associated with the valve members to operate the valve members between open and closed positions;

wherein, a first pair of valve members is ported to the high pressure source;

wherein, a second pair of valve members is ported to the low pressure source;

wherein, a third pair of valve members is ported to the first side of the piston;

wherein, a fourth pair of valve members is ported to the second side of the piston; and wherein, operation of the valve members by the drive assembly to a first configuration shifts the piston in a first direction and operation of the valve members by the drive assembly to a second configuration shifts the piston in a second direction.

2. The hydraulic control system as recited in claim 1 wherein each of the valve members further comprises a 2-way valve.

3. The hydraulic control system as recited in claim 1 wherein each of the valve members further comprises a 2-position valve.

4. The hydraulic control system as recited in claim 1 wherein each of the valve members further comprises a needle valve.

5. The hydraulic control system as recited in claim 1 wherein each of the valve members further comprises a stem operable to form a metal-to-metal seal with a valve seat.

6. The hydraulic control system as recited in claim 1 wherein the drive assembly is operable to sequentially operate the valve members one at a time.

7. The hydraulic control system as recited in claim 1 further comprising at least one power and control assembly.

8. A hydraulic control system for actuating a downhole tool, the hydraulic control system comprising:

a plurality of valve members operable to selectively allow and prevent fluid communication between high and low pressure sources and first and second sides of a piston disposed in an actuator operably associated with the downhole tool; and a drive assembly including a ring gear and at least one motor operably associated with the valve members to operate the valve members between open and closed positions;

wherein, a first valve member is ported between the high pressure source and the first side of the piston;

wherein, a second valve member is ported between the low pressure source and the first side of the piston;

wherein, a third valve member is ported between the high pressure source and the second side of the piston; and wherein, a fourth valve member is ported between the low pressure source and the second side of the piston;

wherein, operation of the first and fourth valve members to the open position and the second and third valve members to the closed position by drive assembly shifts the piston in a first direction and operation of the first and fourth valve members to the closed position and the second and third valve members to the open position by drive assembly shifts the piston in a second direction.

9. The hydraulic control system as recited in claim 8 wherein each of the valve members further comprises a 2-way valve.

10. The hydraulic control system as recited in claim 8 wherein each of the valve members further comprises a 2-position valve.

11. The hydraulic control system as recited in claim 8 wherein each of the valve members further comprises a needle valve.

12. The hydraulic control system as recited in claim 8 wherein each of the valve members further comprises a stem operable to form a metal-to-metal seal with a valve seat.

13. The hydraulic control system as recited in claim 8 wherein the drive assembly is operable to sequentially operate the valve members one at a time.

14. The hydraulic control system as recited in claim 8 further comprising at least one power and control assembly.

* * * * *